US008744116B2

(12) United States Patent
Itano et al.

(10) Patent No.: US 8,744,116 B2
(45) Date of Patent: Jun. 3, 2014

(54) MAGNETIC CIRCUIT FOR SPEAKER AND SPEAKER USING SAME

(75) Inventors: Tetsushi Itano, Mie (JP); Masaki Suzumura, Mie (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/823,762

(22) PCT Filed: Oct. 12, 2011

(86) PCT No.: PCT/JP2011/005696
§ 371 (c)(1),
(2), (4) Date: Mar. 15, 2013

(87) PCT Pub. No.: WO2012/049837
PCT Pub. Date: Apr. 19, 2012

(65) Prior Publication Data

US 2013/0170676 A1 Jul. 4, 2013

(30) Foreign Application Priority Data

Oct. 13, 2010 (JP) ..... 2010-230216

(51) Int. Cl.
*H04R 25/00* (2006.01)

(52) U.S. Cl.
USPC ..... 381/420; 381/190

(58) Field of Classification Search
USPC ..... 381/396, 412, 419, 420
See application file for complete search history.

(56) References Cited

U.S. PATENT DOCUMENTS

2009/0296979 A1 12/2009 Kamimura et al.

FOREIGN PATENT DOCUMENTS

| | | |
|---|---|---|
| JP | 2002-084595 | 3/2002 |
| JP | 2003-009284 | 1/2003 |
| JP | 2009-296160 | 12/2009 |

OTHER PUBLICATIONS

International Search Report of PCT Application No. PCT/JP2011/005696 dated Nov. 29, 2011.

*Primary Examiner* — Davetta W Goins
*Assistant Examiner* — Phylesha Dabney
(74) *Attorney, Agent, or Firm* — Panasonic Patent Center

(57) ABSTRACT

A bond magnet according to the present invention is anisotropic, and a magnetic field is oriented from a lowest edge of side surface of the bond magnet toward an upper section of side surface of the bond magnet. Further, the bond magnet is configured such that the upper section of side surface of the bond magnet is disposed closer to a yoke side surface of a yoke than the lower side surface of the bond magnet is, and the upper section of side surface of the bond magnet faces against the yoke side surface. With this, a magnetic gap is provided between the upper section of side surface of the bond magnet and the yoke side surface. Thus, it is possible to improve a magnetism characteristic of the bond magnet, and to achieve both of magnetic efficiency and productivity of a magnetic circuit for a speaker.

11 Claims, 8 Drawing Sheets

MAGNETIC CIRCUIT FOR SPEAKER AND SPEAKER USING SAME

This application is a U.S. national phase application of PCT international application PCT/JP2011/005696 filed on Oct. 12, 2011, which claims priority to Japanese Patent Application No. 2010-230216 filed on Oct. 13, 2010, the entire contents of which are herein incorporated by reference.

BACKGROUND

1. Technical Field

The present invention relates to a magnetic circuit for a speaker used in audio equipment and video equipment for various purposes including in-car applications, as well as a speaker.

2. Background Art

FIG. 11 is a cross-sectional view of a magnetic circuit in a conventional speaker. Magnetic circuit 101 in the conventional speaker is configured by yoke 102 and bond magnet 103 fixed on yoke 102. Bond magnet 103 is in an annular shape, and includes through hole 103A in its central portion. Further, bond magnet 103 is configured such that the south pole is provided on an inner sidewall of through hole 103A, and the north pole is provided on upper section of side surface 103B. In other words, a magnetic field is oriented in a radial direction of bond magnet 103.

At this time, a magnetic flux loss increases when the north pole provided on upper section of side surface 103B is brought into contact with yoke bottom 102B. Therefore, the cross-section of bond magnet 103 is T-shaped, and bond magnet 103 is disposed such that its upper portion has a greater diameter than that of its lower portion. With this, magnetic gap 104 is provided between upper section of side surface 103B of bond magnet 103 and yoke side wall 102A.

Next, a description will be given of one example of a method for causing bond magnet 103 as described above to be magnetically oriented. A cavity of a mold for conventional bond magnet 103 is made of a non-magnetic material, and in the shape of bond magnet 103. Further, bond magnet 103 is formed by filling the cavity with a resin containing magnetic powder.

However, a face of the cavity corresponding to upper section of side surface 103B is provided as an annular magnetic body. Accordingly, the annular magnetic body is provided with a hole having a shape of upper section of side surface 103B, and upper section of side surface 103B is formed by an inner face of the hole in the annular magnetic body. Further, a stick-shaped magnetic body is provided at a position corresponding to through hole 103A, and through hole 103A is formed by this second magnetic body. Then, the magnetic orientation of bond magnet 103 is achieved by causing magnetism to pass from the stick-shaped magnetic body toward the annular magnetic body when molding.

Here, for example, PTL 1 is known as prior art document information regarding the invention of this application.

CITATION LIST

Patent Literature

PTL 1: Unexamined Japanese Patent Publication No. 2009-296160

SUMMARY

In recent years, in order to prevent global warming, it is desired to reduce materials to be used by downsizing and thinning speakers. In particular, weight reduction of in-car speakers has been strongly desired in order to improve fuel efficiency of automobiles.

However, conventional bond magnet 103 includes through hole 103A. Thus, in order to achieve a magnetism characteristic (magnetic flux density in the magnetic gap) that is equivalent to a case in which a sintered magnet is used, it is necessary to increase a diameter of bond magnet 103. The result of this is an increased weight of the conventional bond magnet.

Therefore, a magnetic circuit using conventional bond magnet 103 has problems that it is difficult to downsize or thin speakers and that the weight of the speakers increases.

Thus, an object of the present invention is to achieve a small, thin, and light bond magnet, thereby solving the above problems and providing an eco-friendly magnetic circuit for a speaker and an eco-friendly speaker.

A magnetic circuit for a speaker provided according to the present invention in order to solve the above problems is configured such that a bond magnet has anisotropy, and that a magnetic field is oriented from a lower side surface of the bond magnet and toward an upper section of side surface of the bond magnet. Further, the bond magnet is configured such that the upper section of side surface of the bond magnet is disposed closer to an inner surface of an outer periphery of a yoke than the lower side surface of the bond magnet is, and that the upper section of side surface of the bond magnet faces against the yoke side surface.

According to the present invention, by providing the above configuration, it is possible to provide a magnetic gap between upper section of side surface of bond magnet and yoke side surface without providing a through hole for the bond magnet, and to converge a magnetic flux to this magnetic gap. Accordingly, it is possible to achieve a high magnetism characteristic without increasing a diameter or a thickness of bond magnet. Therefore, a cubic volume of the bond magnet can be reduced as compared to the conventional example, and thus it is possible to realize a magnetic circuit for a speaker with which weight reduction of the speaker can be achieved in addition to downsizing and thinning.

With the above configuration, it is possible to realize a magnetic circuit for a speaker that is small, thin, and light, and having a high magnetism characteristic, and thereby realizing an eco-friendly speaker.

DESCRIPTION OF EMBODIMENTS

First Exemplary Embodiment

Figure 1:
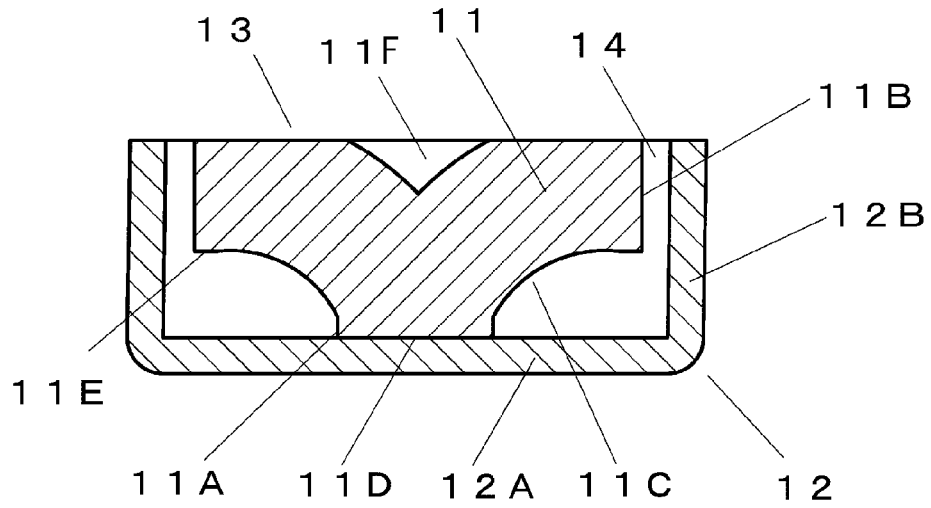
FIG. 1 is a cross-sectional view taken along line 1-1 in FIG. 2 of a magnetic circuit for a speaker according to a first exemplary embodiment of the present invention.
Figure 2:
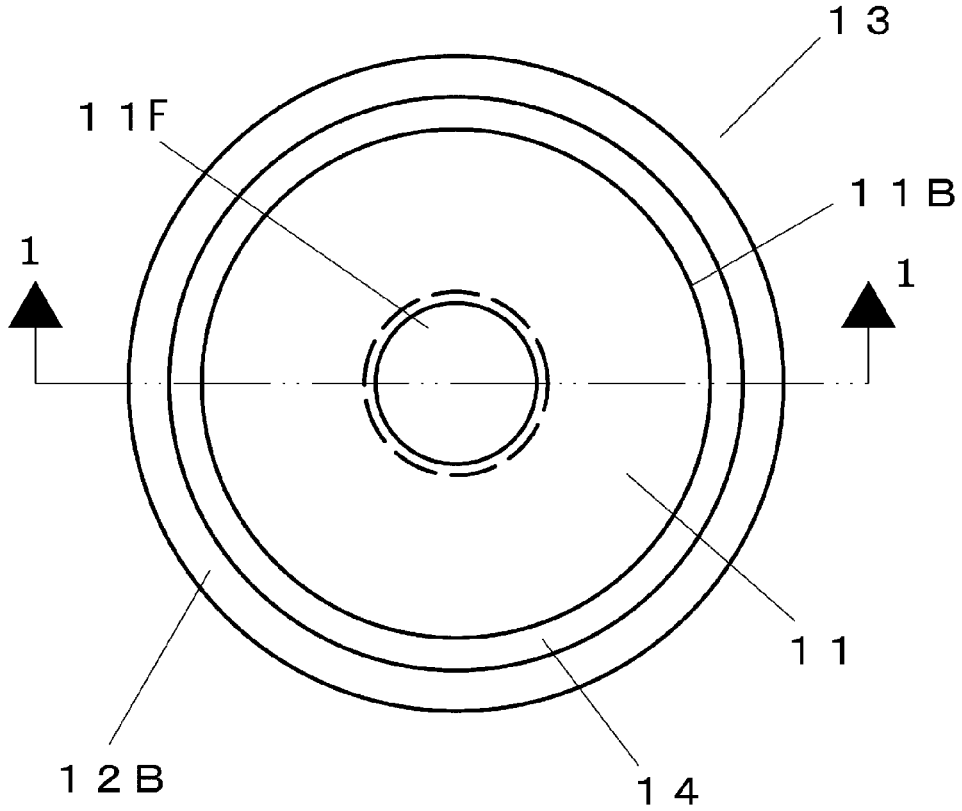
FIG. 2 is a top view of the magnetic circuit for a speaker.
Figure 3:
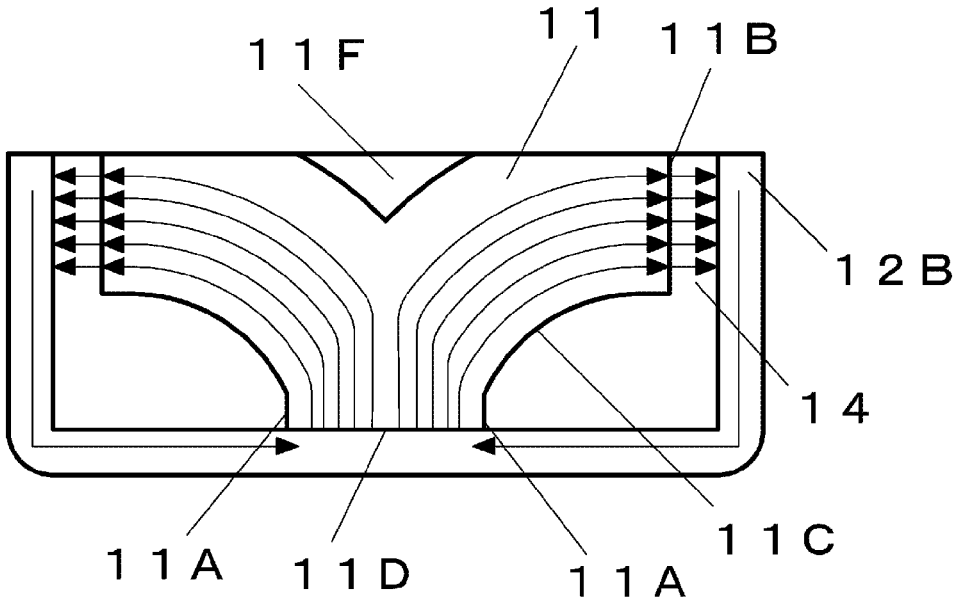
FIG. 3 is a conceptual diagram illustrating a flow of a magnetic flux of the magnetic circuit for a speaker.

Hereinafter, a first exemplary embodiment of the present invention is described with reference to the drawings. FIG. 1 is a cross-sectional view of a magnetic circuit for a speaker according to this exemplary embodiment. FIG. 2 is a top view of the magnetic circuit for a speaker. FIG. 1 shows the cross-sectional view taken along line 1-1 in FIG. 2. FIG. 3 is a schematic diagram illustrating a flow of a magnetic flux of the magnetic circuit for a speaker.

Magnetic circuit 13 for a speaker according to this exemplary embodiment is provided with yoke 12, bond magnet 11, magnetic gap 14, and first connecting section 11C.

Yoke 12 includes yoke bottom 12A, and yoke side surface 12B provided upright for yoke bottom 12A. Bond magnet 11 is fixed on yoke bottom 12A. Magnetic gap 14 is provided between upper section of side surface 11B of bond magnet 11 and an inner surface of yoke side surface 12B. First connecting section 11C connects lowest edge of side surface 11A with upper section of side surface 11B.

Further, upper section of side surface 11B faces against the inner surface of yoke side surface 12B, and upper section of side surface 11B is provided closer to yoke side surface 12B than lowest edge of side surface 11A is. At this time, bond magnet 11 has anisotropy, and is configured such that the polarity of bottom surface 11D of bond magnet 11 is opposite from that of upper section of side surface 11B.

For example, when the south pole is provided on the side of bottom surface 11D of bond magnet 11, the north pole is provided on the side of upper section of side surface 11B. In this case, bond magnet 11 is made of a material having anisotropy, and a magnetic field is oriented from bottom surface 11D toward upper section of side surface 11B (in a direction of an arrow in FIG. 3). Alternatively, in an opposite manner, when the north pole is provided on the side of bottom surface 11D of bond magnet 11, the south pole is provided on the side of upper section of side surface 11B. In this case, bond magnet 11 is made of a material having anisotropy, and a magnetic field is oriented from upper section of side surface 11B toward bottom surface 11D (in a direction opposite of the arrow in FIG. 3).

With such a configuration, without providing a through hole as in the conventional bond magnet, it is possible to provide a magnetic gap between upper section of side surface 11B of bond magnet 11 and yoke side surface 12B and to converge a magnetic flux to this magnetic gap. Accordingly, it is possible to achieve a high magnetism characteristic without increasing a diameter or a thickness of bond magnet 11. Therefore, a cubic volume of the bond magnet can be reduced as compared to the conventional example, and thus it is possible to realize a magnetic circuit for a speaker with which weight reduction of the speaker can be achieved in addition to downsizing and thinning.

Further, as bond magnet 11 has magnetic anisotropy, the magnetic flux is converged to magnetic gap 14. In addition, in anisotropic bond magnet 11, as the magnetic poles are provided with a distance along the magnetic orientation, a permeance coefficient increases and a value of a magnetic flux density of bond magnet 11 also increases. Therefore, a magnetic efficiency of bond magnet 11 is improved and the cubic volume and the weight of bond magnet 11 can be reduced.

Moreover, in bond magnet 11, as the magnetic field is oriented from bottom surface 11D toward upper section of side surface 11B, the magnetic flux is converged at upper section of side surface 11B. Therefore, the magnetic flux density in magnetic gap 14 increases by an amount by which the thickness of bond magnet 11 is increased beyond a driving range of voice coil 28 (see FIG. 10A). In other words, it is possible to easily increase the magnetic flux density of magnetic gap 14 in proportion to an increase of the cubic volume of bond magnet 11.

With the configuration described above, bond magnet 11 according to this exemplary embodiment can be provided with a favorable magnetism characteristic, as well as downsized and thinned, as compared to the bond magnet according to the conventional example. Therefore, by employing magnetic circuit 13 for a speaker according to this exemplary embodiment in a speaker, it is possible to allow weight reduction of the speaker, as well as downsizing and thinning, thereby realizing an eco-friendly speaker.

Further, as the magnetic field is oriented from lowest edge of side surface 11A toward upper section of side surface 11B, bond magnet 11 has magnetic anisotropy in this orientation. With such a configuration, the magnetic flux can be efficiently converged at the gap portion without providing a plate on an upper portion of bond magnet 11. Accordingly, it is possible to realize the magnetic circuit with only two pieces of components, and thus lead to increased productivity.

In the following, the configuration of this exemplary embodiment will be described more specifically. As illustrated in FIG. 1 and FIG. 2, yoke 12 is circular, and yoke side surface 12B is provided upright along an outer peripheral edge of disk-shaped yoke bottom 12A. Bond magnet 11 is also circular, and provided in the center of an upper surface of disk-shaped yoke bottom 12A. Here, bond magnet 11 is fixed to the upper surface of yoke bottom 12A (within the yoke) by means of an adhesive agent and the like. As a result, bond magnet 11 is enclosed by yoke 12 excluding an upper surface of bond magnet 11.

Here, a cross-sectional shape of bond magnet 11 is configured such that upper section of side surface 11B has a greater diameter than that of bottom surface 11D, and the connecting section connecting upper section of side surface 11B with lowest edge of side surface 11A is inclined with respect to yoke bottom 12A. Further, upper section of side surface 11B faces against yoke side surface 12B. Hereinafter, such a cross-sectional shape is referred to as a quasi trapezoid. Moreover, bond magnet 11 is disposed in a manner that the side of bottom surface 11D of bond magnet 11 faces toward the side of yoke bottom 12A. Hereinafter, a cross-sectional shape of bond magnet 11 when disposed in such a manner is referred to as an inverted trapezoidal shape.

FIG. 3 is a schematic diagram illustrating the magnetic circuit according to this exemplary embodiment. Referring to FIG. 3, magnetic circuit 13 is configured by bond magnet 11, yoke 12, and magnetic gap 14 provided between bond magnet 11 and yoke side surface 12B.

According to this exemplary embodiment, first connecting section 11C connecting lowest edge of side surface 11A with upper section of side surface 11B is inclined with respect to yoke bottom 12A, and connected to lowest edge of side surface 11A and to upper section of side surface 11B. Here, an inclination angle between a surface of first connecting section 11C and a surface of yoke bottom 12A is acute. In other words, in bond magnet 11, an inclination angle between bottom surface 11D and first connecting section 11C is obtuse. With this, it is possible to reduce a magnetic flux loss in magnetic circuit 13, and to increase the magnetic flux density in magnetic gap 14.

With the above configuration, as first connecting section 11C is inclined with respect to yoke bottom 12A, the cubic volume of bond magnet 11 increases by this amount. Therefore, the magnetic efficiency of bond magnet 11 can be improved. With this, it is possible to increase a magnetic force without increasing the diameter or the height of bond magnet 11. Therefore, the magnetic flux density in magnetic gap 14 can be increased.

Here, voice coil 28 is configured such that an upper end of the voice coil may not be separated from a lower end of magnetic gap 14 even when an input signal greater than a rated input for a signal (excessive signal) is inputted. Accordingly, upper section of side surface 11B is disposed so as to be included within a maximum driving range directed downward from voice coil 28. In other words, a downward bottom dead center of the upper end of voice coil 28 is above a lower end of the upper section of side surface 11B. Here, a maximum driving range refers to a range loosely set for a driving range for an excessive signal. It should be noted that in this exemplary embodiment, the length of upper section of side surface 11B is the same as that of the maximum driving range.

Further, in terms of reliability of the speaker, the gap is provided between the lower end of voice coil 28 and yoke bottom 12A at the bottom dead center of the maximum driving range. In addition, as the polarities of upper section of side surface 11B and yoke bottom 12A are opposite, the gap is required between upper section of side surface 11B and a bottom surface of yoke 12.

As bond magnet 11 according to this exemplary embodiment is provided with first connecting section 11C so as to be inclined at this gap portion, the cubic volume of bond magnet 11 increases by this amount. Therefore, as the cubic volume of bond magnet 11 can be increased by effectively using a region of the gap, it is possible to increase the magnetic flux density without increasing the thickness of bond magnet 11.

Here, according to this exemplary embodiment, it is considered that a portion around a position about a half of a surface distance from lowest edge of side surface 11A to the lower end of upper section of side surface 11B corresponds to a boundary between the south pole and the north pole. In other words, the side of bottom surface 11D of this boundary position corresponds to the south pole, which is the same as the polarity of yoke bottom 12A. Therefore, in first connecting section 11C, the magnetic pole at a portion near yoke bottom 12A has the same polarity as that of yoke bottom 12A.

With this, the magnetism may not leak to yoke bottom 12A from a portion of first connecting section 11C near yoke bottom 12A or lowest edge of side surface 11A. Therefore, generation of a magnetic flux loss does not increase even if first connecting section 11C is inclined to yoke bottom 12A, and it is possible to achieve bond magnet 11 having a favorable magnetism characteristic.

Here, in this exemplary embodiment, second connecting section 11E is provided between first connecting section 11C and upper section of side surface 11B. Second connecting section 11E is provided perpendicular to upper section of side surface 11B. With this, as it is also possible to make the orientation of the magnetic field at upper section of side surface 11B substantially perpendicular to upper section of side surface 11B and yoke side surface 12B. Therefore, the magnetic flux can be converged to upper section of side surface 11B, and to magnetic gap 14, it is possible to reduce the cubic volume, as well as the weight, of bond magnet 11 without reducing the magnetic flux density at magnetic gap 14.

Here, as the magnetic flux is directed toward different directions at a central portion of an upper end of bond magnet 11, and thus the magnetic flux density within the magnet decreases at this portion, an influence of this portion to the magnetic flux density at the magnetic gap portion is very small. And so, a recess is provided in the central portion of the upper surface of bond magnet 11. In other words, the cross-section of bond magnet 11 is substantially Y-shaped. With this, the cubic volume of within bond magnet 11 is reduced, and it is possible to reduce the weight of bond magnet 11. Here, the shape of recess 11F is made similar to the shape of first connecting section 11C. By providing the recess in this manner, the magnetic flux within bond magnet 11 can smoothly reach upper section of side surface 11B. More desirably, the shape of recess 11F is made to have a like figure with the shape of first connecting section 11C. According to this configuration, the magnetic flux within bond magnet 11 can reach upper section of side surface 11B even more smoothly.

Figure 4:
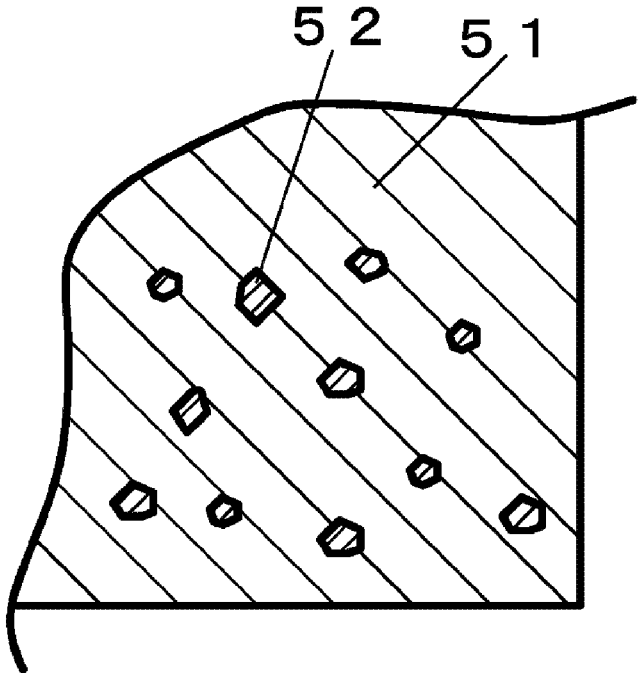
FIG. 4 is an enlarged cross-sectional view of a main part of a bond magnet in the magnetic circuit for a speaker.

Next, a material used for bond magnet 11 according to this exemplary embodiment is described in detail. FIG. 4 is an enlarged cross-sectional view of a main part of the bond magnet according to this exemplary embodiment. In FIG. 4, magnetic powder 52 used for bond magnet 11 needs to be anisotropic magnetic powder. Therefore, for magnetic powder 52, materials such as ferrite based, alnico based, Sm—Co based, Nd—Fe—B based, Sm—Fe—N based, and Fe—N based are used, for example. Magnetic powder 52 can be made of a single material or of a mixture of two or more materials.

Here, the shape of magnetic powder 52 used in the material according to this exemplary embodiment is polyhedral or polygonal plate-like. Therefore, an area in which resin 51 is in contact with magnetic powder 52 becomes large, and therefore an adhesive strength with resin 51 can be increased. With this, it is possible to make it less susceptible to cracking and such due to a drop impact. In particular, upper section of side surface 11B of bond magnet 11 is less susceptible to deformation of the shape due to dropping and such, and therefore it is possible to make the magnetic force on upper section of side surface 11B even.

It should be noted that by performing an anti-oxidation treatment or a coupling treatment to magnetic powder 52, the adhesive strength between magnetic powder 52 and resin 51 can be further increased. Therefore, bond magnet 11 becomes even less susceptible to deformation of the shape due to a drop impact.

Further, the shape of magnetic powder 52 according to this exemplary embodiment is uneven. In other words, magnetic powder 52 of so-called quasi infinite form is used for bond magnet 11. With this, an internal loss of bond magnet 11 can be increased in a wide range of vibration frequencies. Therefore, as it is possible to make resonance due to vibration of diaphragm 27 that will be later described less likely to occur, magnetic circuit 13 that is able to reproduce high-quality sound can be achieved.

Moreover, it is preferable that magnetic powder 52 having a grain diameter of 400 μm or smaller be used. With this, it is possible to prevent magnetic powder 52 from interrupting flowability of resin 51 for injection molding. Here, magnetic powder whose average grain diameter is from 1 μm to 400 μm is used as magnetic powder 52 according to this exemplary embodiment. In this manner, magnetic powder 52 having a relatively large grain size distribution is used, and therefore bond magnet 11 contains magnetic powder 52 of various sizes mixed therein. By containing magnetic powder 52 of various sizes mixed therein in this manner, the internal loss of bond magnet 11 can be increased in a wide range of vibration frequencies. Therefore, as it is possible to make the resonance due to vibration of diaphragm 27 that will be later described less likely to occur, magnetic circuit 13 that is able to reproduce high-quality sound can be achieved.

However, in such a case when it is desired to increase the magnetic force of magnetic gap 14 for small-sized bond magnet 11, it is particularly preferable to use magnetic powder 52 whose grain size distribution is from 1 μm to 30 μm. In this manner, by using magnetic powder 52 whose grain diameter and grain size distribution are small, it is possible to increase a filling rate of magnetic powder 52 in resin 51. Further, it is possible to maintain favorable resin flowability when molding even if the filling rate of magnetic powder 52 in resin 51 is increased. Therefore, magnetic powder 52 can be distributed evenly in resin 51. With this, it is possible to realize bond magnet 11 having favorable orientation of the magnetic powder.

Further, magnetic powder 52 is less susceptible to contraction in injection molding. Therefore, it is possible to make shape stability of bond magnet 11 favorable (size variation is reduced) by filling a large amount of such magnetic powder 52. With this, as an interval of magnetic gap 14 can be reduced, the magnetic flux density in magnetic gap 14 can be increased.

Next, a material of resin 51 that constitutes bond magnet 11 is not particularly limited as long as it is made of a thermoplastic resin material. When using a thermoplastic resin, materials such as polypropylene, polyethylene, polyvinyl chloride, polyester, polyamide, polycarbonate, polyvinyl alcohol, and polyphenylene sulfide can be used, for example. Further, when using a thermoplastic elastomer, materials such as olefin based, ester based, and polyamide based can be used, for example. Moreover, the resin or the elastomer can be made of a single material or of a mixture of two or more materials.

As the resin for bond magnet 11 according to this exemplary embodiment, a virgin material is used. However, the resin for bond magnet 11 can be partly or entirely made of a recycled resin. With this, it is possible to reduce a consumed amount of petroleum resources. Therefore, as reduction of depletion of petroleum resources and carbon dioxide emissions can be realized, it is possible to protect the global environment.

According to Home Appliance Recycling Act in Japan, manufacturers are obliged to collect discarded home electrical appliances manufactured by their own. According to this law, products to be collected include air conditioners, television sets, refrigerators, freezers, laundry machines, and cloth driers (as of end of August, 2011). At this time, as the manufactures collect their products, they fully know what kind of resin materials and metallic materials are used for those products. Therefore, it is possible to easily segregate resins and metals according to their kinds.

Although a ratio of the magnetic powder mixed in the resin depends on the type of the resin, it is possible to achieve a desired magnetism characteristic by setting a content rate of 30% by weight or greater. At this time, assuming that the ratio of the magnetic powder in the bond magnet as a whole is 40% or greater in a cubic volume ratio, it is possible to achieve bond magnet 11 having a superior magnetic performance. Further, the ratio of the magnetic powder in the bond magnet as a whole is 90% at maximum. With this, it is possible to suppress deterioration of flowability of resin 51. Moreover, it is possible to make bond magnet 11 less susceptible to cracking when mounted on an automobile due to vibration.

Here, antioxidizing agent may be added. In addition, it is possible to improve the orientation of the magnetic powder by adding a lubricant.

Here, first connecting section 11C according to this example is in a circular arc cross-sectional shape. With this, as the distance between the magnetic poles of bond magnet 11 increases, the permeance coefficient increases and a value of the magnetic flux density also increases. With this, it is possible to further improve the magnetic efficiency, and reduce the required cubic volume and weight. Here, in this case, first connecting section 11C is curved in a direction of the recess. With this, it becomes easier to make the orientation of the magnetic field at upper section of side surface 11B perpendicular to upper section of side surface 11B and yoke side surface 12B. Therefore, as the magnetic flux can be converged to upper section of side surface 11B, and to magnetic gap 14, it is possible to reduce the cubic volume, as well as the weight, of bond magnet 11 without reducing the magnetic flux density at magnetic gap 14.

As described above, in this example, it is described that by forming first connecting section 11C from lowest edge of side surface 11A of bond magnet 11 to upper section of side surface 11B of bond magnet 11 to have a circular arc cross-sectional shape, the magnetic efficiency can be further improved and the required cubic volume and weight can be reduced. However, the shape of first connecting section 11C is not limited to the shape according to this example, and can be in a different shape such as a linear shape.

Figure 5A:
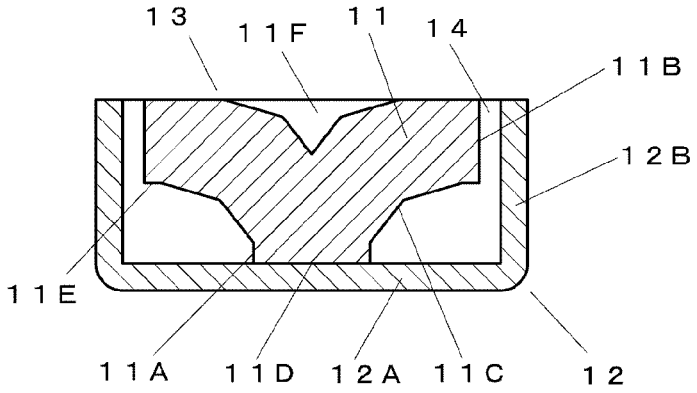
FIG. 5A is a cross-sectional view of a magnetic circuit for a speaker according to a second example of the first exemplary embodiment of the present invention.
Figure 5B:
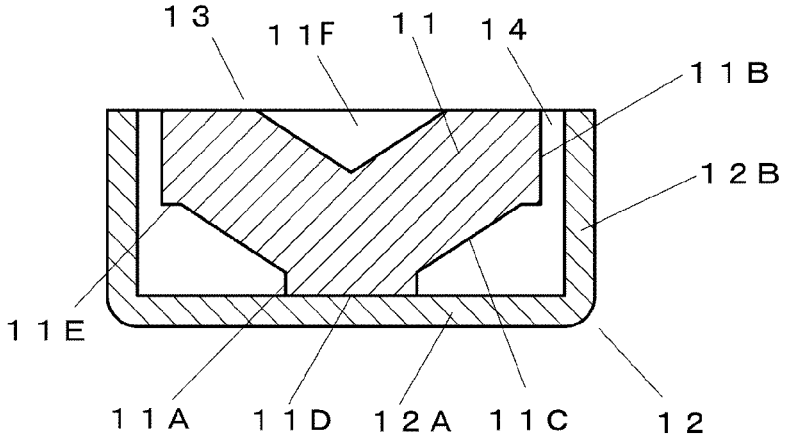
FIG. 5B is a cross-sectional view of a magnetic circuit for a speaker according to a third example of the first exemplary embodiment of the present invention.
Figure 5C:
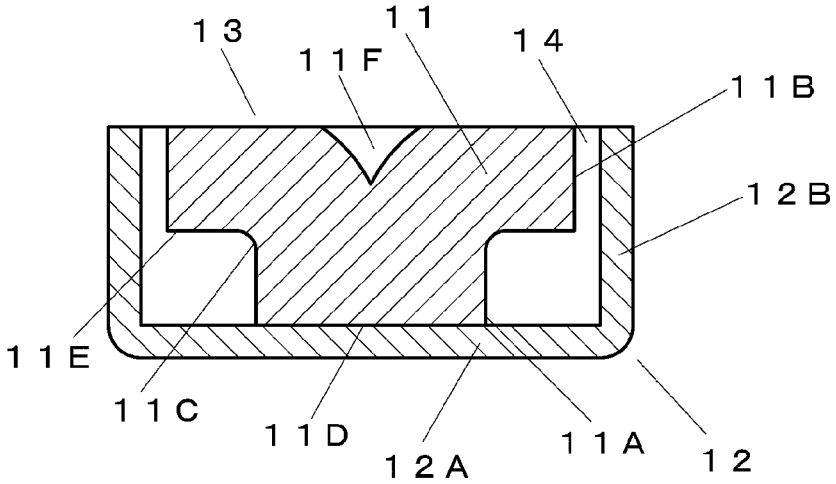
FIG. 5C is a cross-sectional view of a magnetic circuit for a speaker according to a fourth example of the first exemplary embodiment of the present invention.

FIG. 5A is a cross-sectional view of the magnetic circuit for a speaker having a first connecting section according to a second example, FIG. 5B is a cross-sectional view of the magnetic circuit for a speaker having a first connecting section according to a third example, and FIG. 5C is a cross-sectional view of the magnetic circuit for a speaker having a second connecting section according to a fourth example. As illustrated in FIG. 5A, FIG. 5B, and FIG. 5C, first connecting section 11C in the second, the third, or the fourth example is linear, and this is a difference from first connecting section 11C according to the first example. As described above, by forming first connecting section 11C in a linear shape as in the second and the third examples, it is possible to facilitate manufacturing of a mold, and thus to reduce the cost for the mold.

Here, first connecting section 11C in the second example is different from first connecting section 11C in the third example in that first connecting section 11C in the second example includes a bent portion. The bent portion has a shape such that the bent portion is flexed toward a direction of the recess in its cross-section. With this, it becomes easier to make the orientation of the magnetic field at upper section of side surface 11B perpendicular to upper section of side surface 11B and yoke side surface 12B. Therefore, as the magnetic flux can be converged to upper section of side surface 11B, and to magnetic gap 14, it is possible to reduce the cubic volume, as well as the weight, of bond magnet 11 without reducing the magnetic flux density at magnetic gap 14.

Further, first connecting section 11C in the fourth example is different from first connecting section 11C in the second example in that first connecting section 11C in the fourth example is perpendicular to yoke bottom 12A and that an angle of the bent portion is 90 degrees. In other words, in this example, first connecting section 11C also functions as second connecting section 11E. With this, it is ensured that the orientation of the magnetic field at upper section of side surface 11B becomes perpendicular to upper section of side surface 11B and yoke side surface 12B. Therefore, the magnetic flux can be further converged to upper section of side surface 11B, and to magnetic gap 14. Accordingly, it is possible to reduce the cubic volume, as well as the weight, of bond magnet 11 without reducing the magnetic flux density at magnetic gap 14. Further, unlike conventional bond magnet 103, through hole 103A is not provided, and therefore the cubic volume can be increased even with the same diameter and the same thickness as those of conventional bond magnet 103, and it is possible to achieve bond magnet 11 having a large magnetic force.

It should be noted that, while circular bond magnet 11 is described in this example, the shape of bond magnet 11 according to the present invention is not limited to such an example, and can be polygonal, ellipsoidal, track-shaped, rectangular, or the like. In the following, cases to which bond magnet 11 according to the present invention is applied are used to magnetic circuit 13 of representative shapes.

Figure 6A:
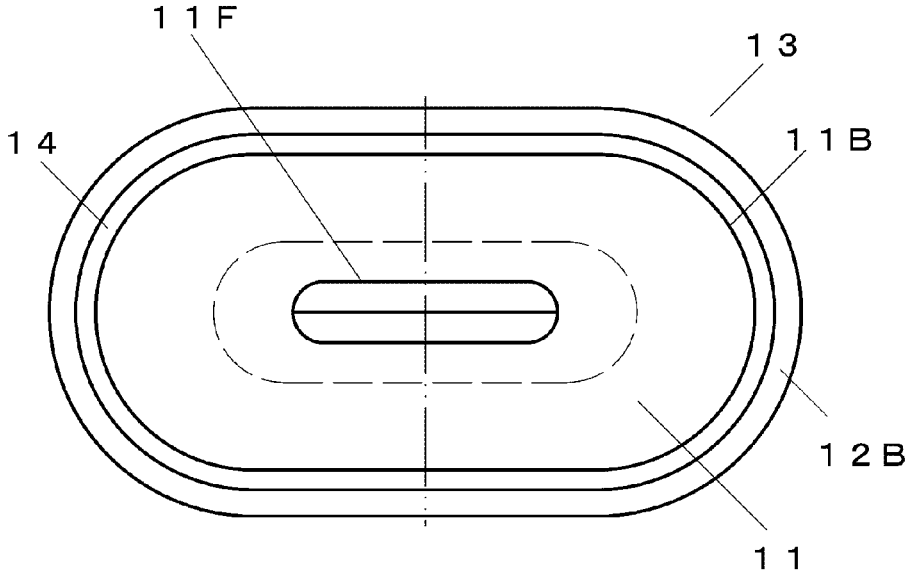
FIG. 6A is a top view of a magnetic circuit for a speaker according to a fifth example of the first exemplary embodiment of the present invention.
Figure 6B:
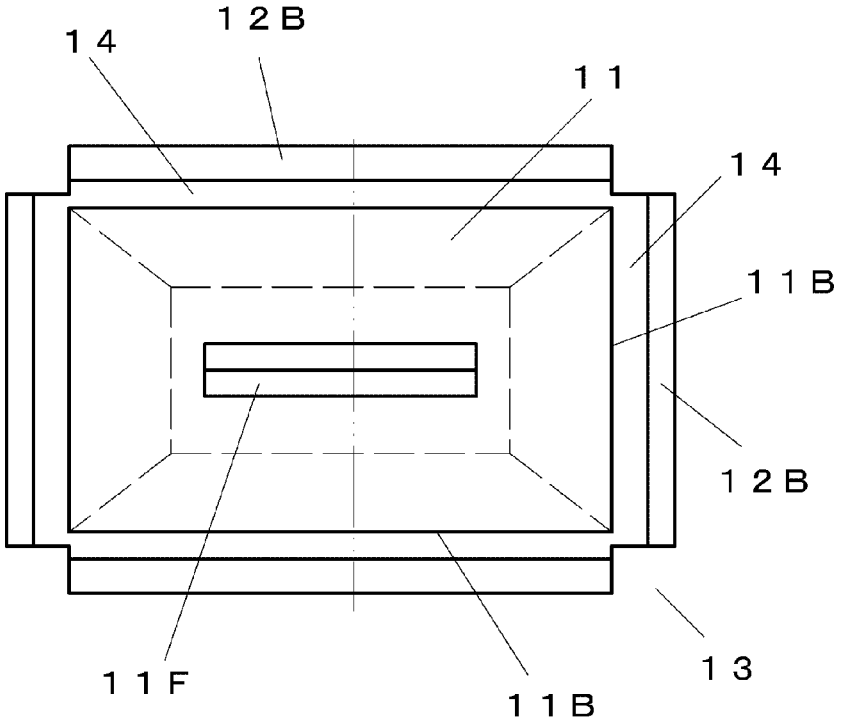
FIG. 6B is a top view of a magnetic circuit for a speaker according to a sixth example of the first exemplary embodiment of the present invention.

FIG. 6A is a top view of a magnetic circuit for a speaker according to a fifth example, and FIG. 6B is a top view of a magnetic circuit for a speaker according to a sixth example. As illustrated in FIG. 6A, in magnetic circuit 13 according to the fifth example, bond magnet 11 and yoke bottom 12A are both track-shaped. Further, as illustrated in FIG. 6B, in magnetic circuit 13 according to the sixth example, bond magnet 11 and yoke bottom 12A are both rectangular. Here, by making recess 11F track-shaped too in the case of the fifth example, and by making recess 11F rectangular too in the case of the sixth example, it is possible to reduce the magnetic flux loss in the central portion of the upper end.

Figure 7:
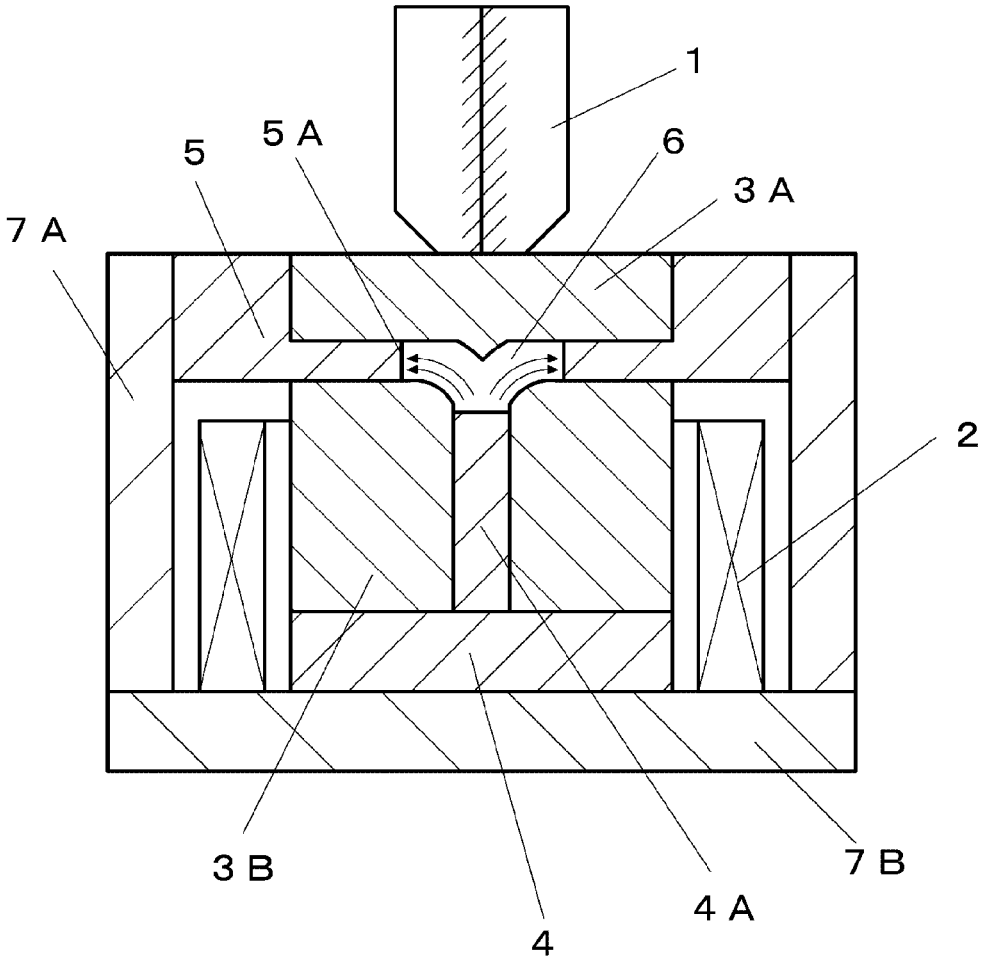
FIG. 7 is a cross-sectional view of a manufacturing apparatus used for manufacturing the bond magnet for a speaker according to the first exemplary embodiment of the present invention.

Next, a method of manufacturing bond magnet 11 according to this exemplary embodiment is described with reference to the drawings. FIG. 7 is a manufacturing apparatus used for manufacturing bond magnet 11 according to this exemplary embodiment. Bond magnet 11 according to this exemplary embodiment is provided by injection molding a mixed material of a resin, magnetic powder, and such.

First, the manufacturing apparatus for manufacturing bond magnet 11 according to this exemplary embodiment is described. The manufacturing apparatus for manufacturing bond magnet 11 performs injection molding of the mixed material of a resin, magnetic powder, and such into cavity 6. Here, cavity 6 has a shape (of bond magnet 11) such that its cross-section is in an inverted trapezoidal shape. Then, a wall surface of cavity 6 is made of non-magnetic material 3. Here, an upper surface of cavity 6 is defined by upper non-magnetic material 3A, and surfaces corresponding to lowest edge of side surface 11A, first connecting section 11C, and second connecting section 11E are defined by lower non-magnetic material 3B.

Lower non-magnetic material 3B is disposed on lower magnetic material 4, and a side surface of lower magnetic material 4 is exposed from the lower non-magnetic material. Here, lower magnetic material 4 includes projection 4A, and projection 4A is enclosed by non-magnetic material 3B. However, a tip end of projection 4A is exposed at a portion corresponding to bottom surface 11D of bond magnet 11 within an inner wall of cavity 6.

Outer peripheral magnetic material 5 is disposed between upper non-magnetic material 3A and lower non-magnetic material 3B, and outer peripheral magnetic material 5 includes a hole for forming side walls. Then, by exposing an inner periphery of hole for forming side walls to the inner wall of cavity 6, a surface corresponding to upper section of side surface 11B is provided for cavity 6.

Coil 2 is provided so as to form a magnetic field within cavity 6, and disposed so as to enclose an exposed portion of lower magnetic material 4. Then, by supplying a current to coil 2, a magnetic field is generated in a vertical direction (from upside toward downside in FIG. 7). Further, as lower magnetic material 4 and outer peripheral magnetic material 5 are magnetic bodies, the magnetic field generated by coil 2 flows within cavity 6 following the shape of cavity 6 (first connecting section 11C and second connecting section 11E). With this, it is possible to achieve orientation of the magnetic field directed from an upper surface of the projection toward hole for forming side walls 5A of outer peripheral magnetic material 5 within cavity 6.

Further, the magnetic field is efficiently oriented within cavity 6 by the magnetic field generated by coil 2 being directed from outer peripheral magnetic material 5 back toward lower magnetic material 4 via pole 7A of the magnetic body and base portion 7B of the magnetic body.

With the configuration as described above, the magnetic field generated by energized coil 2, the magnetic field is generated within cavity 6 such that the magnetic field is directed from the upper surface of projection 4A toward the inner surface of hole for forming side walls 5A (see an arrow in FIG. 7). Further, by resin molding the mixed material of the resin and the magnetic powder in such a magnetic field, it is possible to make an easy axis of magnetization of bond magnet 11 oriented in a direction of a magnetic line generated within cavity 6. With this, bond magnet 11 whose magnetic field is oriented from lowest edge of side surface 11A toward upper section of side surface 11B as illustrated in FIG. 3 (as shown by an arrow in FIG. 3) can be provided.

Moreover, by providing an inclination in first connecting section 11C as in the cases from the first to the third examples, it is possible to make flowability of the resin favorable, and to ensure the orientation of the magnetic field. Furthermore, as in the case of the fourth example, R may be provided at the bent portion of first connecting section 11C. With this, it is possible to make flowability of the resin favorable, and the orientation of the magnetic field can be further ensured.

Here, the molding method is not particularly limited, and extrusion molding, compression molding, or injection molding can be employed, for example. It should be noted that it is particularly preferable that the molding be performed by injection molding in terms of productivity and easiness in installation of orientation facilities.

Further, in the magnetic circuit in the sixth example, yoke 12 and bond magnet 11 can be molded integrally by preliminarily placing yoke 12 within the cavity of the mold. In this case, however, yoke side surface 12B is not provided along a short side of yoke 12. Moreover, yoke 12 is provided with a magnetic field directed from the outer periphery along a long side of yoke 12 toward the center. With this, the magnetic field generated by coil 2 may not flow to yoke 12, but flows within cavity 6. Therefore, the bond magnet and the yoke can be joined without using an adhesive agent, and it is possible to achieve magnetic circuit 13 with higher productivity.

It should be noted that while the case in which vertical injection molding machine 1 is used is described in the above example, a horizontal injection molding machine can also be used.

Second Exemplary Embodiment

Figure 8:
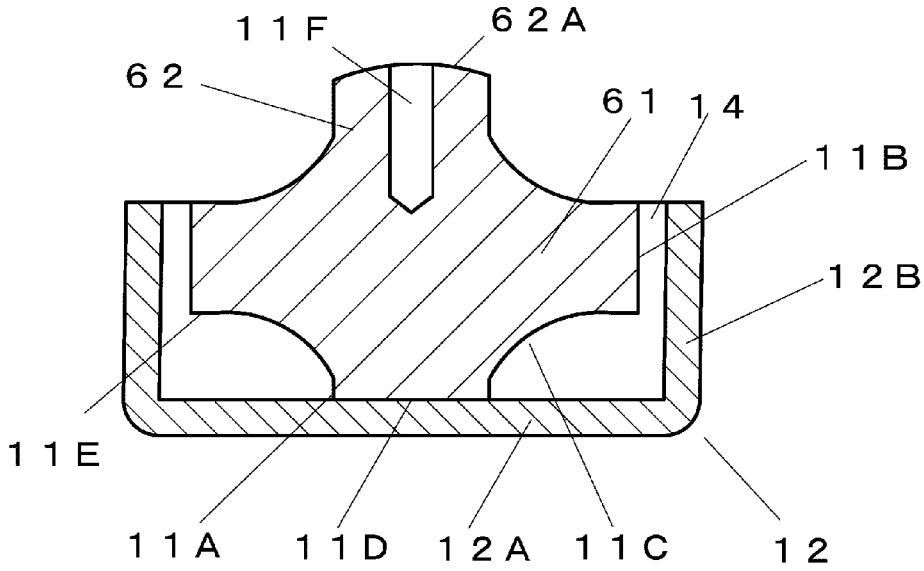
FIG. 8 is a cross-sectional view of a magnetic circuit for a speaker according to a second exemplary embodiment of the present invention.
Figure 9:
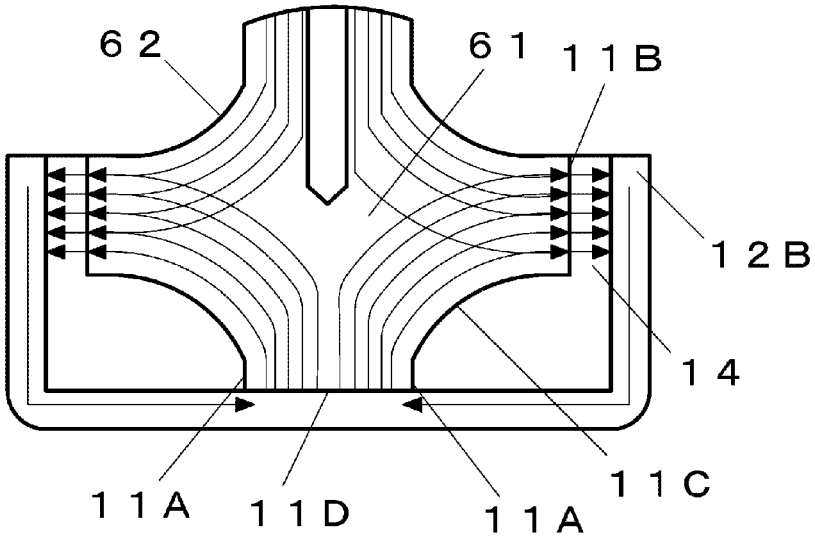
FIG. 9 is a conceptual diagram illustrating a flow of a magnetic flux of the magnetic circuit for a speaker.

In the following, a second exemplary embodiment of the present invention is described with reference to the drawings. FIG. 8 is a cross-sectional view of a magnetic circuit for a speaker according to the exemplary embodiment of the present invention. FIG. 9 is a conceptual diagram illustrating a flow of a magnetic flux of the magnetic circuit for a speaker. For magnetic circuit 13 according to this exemplary embodiment, bond magnet 61 having a projection is used. Bond magnet 61 having a projection is provided with projection 62 in a central portion in the upper surface of bond magnet 11.

Then, similarly to the first exemplary embodiment, bond magnet 61 having a projection has magnetic orientation directed from bottom surface 11D toward upper section of side surface 11B. In addition, bond magnet 61 having a projection also has magnetic orientation directed from upper surface 62A of projection 62 toward upper section of side surface 11B. In other words, a magnetic flux from upper surface 62A of projection 62 to upper section of side surface 11B is directed toward a repulsive direction with respect to the magnetic flux from bottom surface 11D toward upper section of side surface 11B. This is a configuration in which a so-called repulsive magnetic field is added.

With this, the magnetic flux density in magnetic gap 14 is increased by the magnetic flux directed from upper surface 62A of projection 62 toward upper section of side surface 11B. Further, the magnetic flux directed from bottom surface 11D toward upper section of side surface 11B is overpowered from upside, a magnetic field leakage at an upper surface of bond magnet 61 having a projection can be made small. With these, the magnetic flux density in magnetic gap 14 is further increased.

Further, it is preferable to provide a plate of a magnetic body (undepicted) on the upper surface of projection 62. With this, it is possible to further improve the magnetic efficiency of magnetic circuit 13. Here, in this case, it is preferable that the upper surface of projection 62 be made flat. With this, it is possible to manufacture the plate of the magnetic body easily.

Third Exemplary Embodiment

Figure 10A:
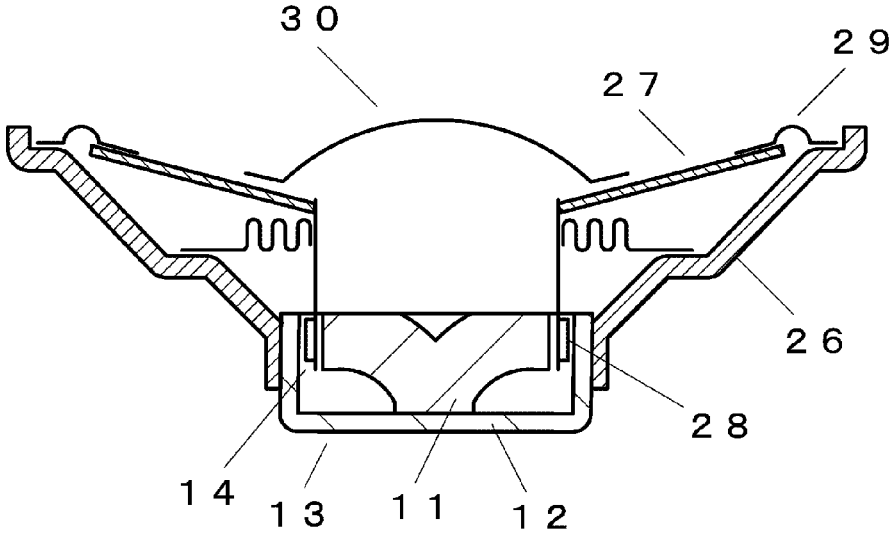
FIG. 10A is a cross-sectional view of a speaker according to a third exemplary embodiment of the present invention.

In the following, a third exemplary embodiment of the present invention is described with reference to the drawings. FIG. 10A is a cross-sectional view of a speaker according to this exemplary embodiment.

As illustrated in FIG. 10A, bond magnet 11 according to any of the examples of first exemplary embodiment is used as bond magnet 11 according to this exemplary embodiment. In other words, bond magnet 11 is magnetized from bottom surface 11D toward upper section of side surface 11B. Then, inner-pole type magnetic circuit 13 is configured by fixing bond magnet 11 to yoke 12.

Frame 26 is coupled to yoke 12 of magnetic circuit 13. Further, an outer periphery of diaphragm 27 is adhered to circumference of frame 26 via an edge 29. Then, one end of voice coil 28 is coupled to a central portion of diaphragm 27, and the other end of voice coil 28 is fitted into magnetic gap 14 of magnetic circuit 13. Here, dust cap 31 is connected to the central portion of diaphragm 27.

As described above, by using bond magnet 11 according to first exemplary embodiment, it is possible to achieve speaker 30 capable of realizing both of high productivity and size and weight reduction that cannot be realized with the conventional example.

Figure 10B:
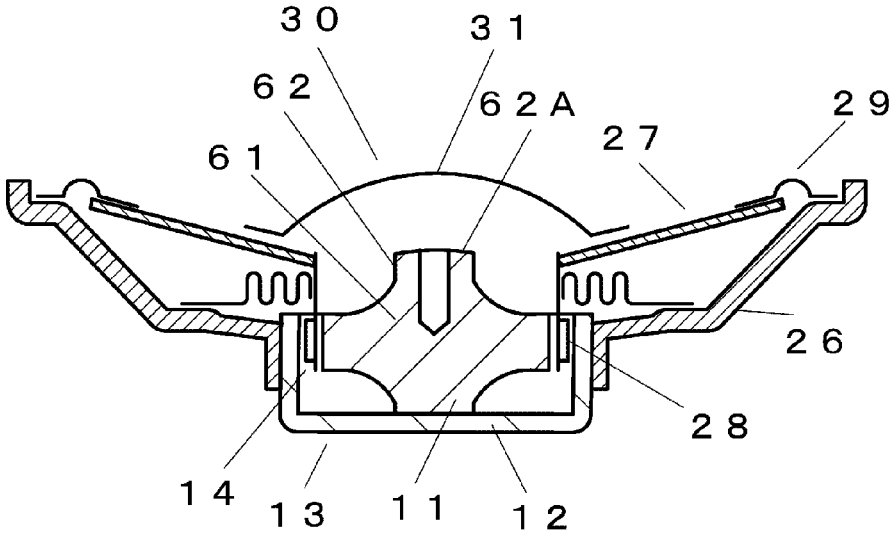
FIG. 10B is a cross-sectional view of a speaker according to a second example of the third exemplary embodiment.
Figure 11:
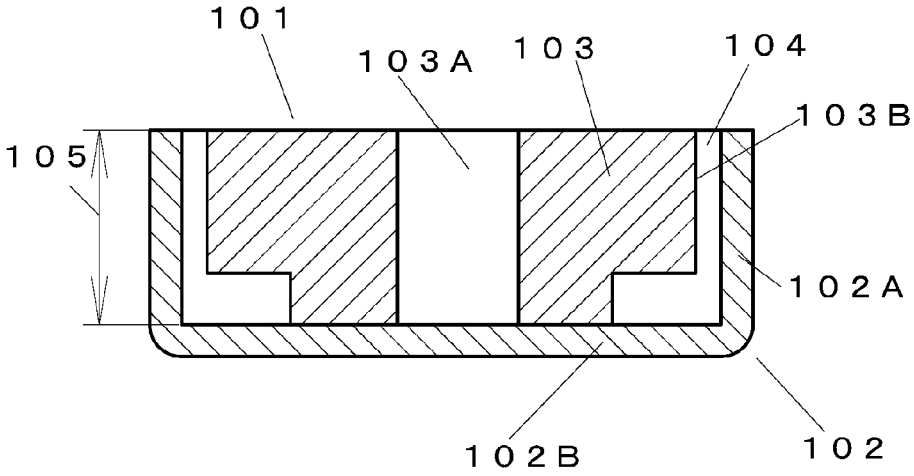
FIG.11 PRIOR ART
FIG. 11 is a cross-sectional view of a conventional magnetic circuit for a speaker.

FIG. 10B is a cross-sectional view of a speaker according to a second example of this exemplary embodiment. As illustrated in FIG. 10B, bond magnet 61 having a projection is used in speaker 30 of the second example.

With this, it is possible to further increase the magnetic flux density in magnetic gap 14. Therefore, a speaker with a high sound pressure level can be realized.

Further, as dust cap 31 is provided so as to project from diaphragm 27, projection 62 can be stored within dust cap 31. Therefore, it is not necessary to increase the size of speaker 30 even if projection 62 is provided.

Here, according to this exemplary embodiment, upper surface 62A of projection 62 of bond magnet 61 having a projection has a shape following the shape of dust cap 31. With this, dust cap 31 may not be easily brought into contact with projection 62 of bond magnet 61 having a projection due to vibration of diaphragm 27.

INDUSTRIAL APPLICABILITY

The present invention is useful for a speaker that is small and light, and for which high productivity is required.

What is claimed is:

1. A magnetic circuit for a speaker, comprising:

a yoke having a yoke bottom and a yoke side surface provided upright on the yoke bottom;

a bond magnet fixed onto the yoke bottom;

a magnetic gap provided between an upper section of side surface of the bond magnet and an inner surface of the yoke side surface; and a first connecting section connecting a lowest edge of side surface of the bond magnet with the upper section of side surface, wherein the upper section of side surface faces against the inner surface of the yoke side surface, the upper section of side surface is disposed closer to the yoke side surface than the lowest edge of side surface is, the bond magnet is anisotropic, a magnetic field is oriented from a bottom surface of the bond magnet toward the upper section of side surface, and the first connecting section is provided in an inclined manner with respect to the yoke bottom.

2. The magnetic circuit for a speaker according to claim 1, wherein an inclination angle between the bottom surface of the bond magnet and the first connecting section is obtuse.

3. The magnetic circuit for a speaker according to claim 2, wherein a cross-sectional shape of the first connecting section is in a circular arc shape, and the first connecting section is provided with a recess.

4. The magnetic circuit for a speaker according to claim 2, wherein a second connecting section is provided between the upper section of side surface and an upper end of the first connecting section, and the second connecting section is provided perpendicularly to the upper section of side surface.

5. The magnetic circuit for a speaker according to claim 2, wherein the magnetic field within the bond magnet is oriented following a shape of the first connecting section.

6. The magnetic circuit for a speaker according to claim 1, wherein a recess is provided in a central portion of an upper surface of the bond magnet.

7. The magnetic circuit for a speaker according to claim 1, wherein a cross-sectional shape of the first connecting section is in a linear shape.

8. The magnetic circuit for a speaker according to claim 7, wherein the first connecting section is provided with a bent portion.

9. The magnetic circuit for a speaker according to claim 1, wherein the bond magnet is provided by injection molding.

10. The magnetic circuit for a speaker according to claim 1, wherein a projection is provided in a central portion of an upper surface of the bond magnet, and the magnetic field is oriented from the projection toward the upper section of side surface.

11. A speaker, comprising:

a yoke having a yoke bottom and a yoke side surface provided upright on the yoke bottom;

a bond magnet fixed within the yoke bottom;

a magnetic gap provided between an upper section of side surface of the bond magnet and an inner surface of the yoke side surface;

a first connecting section connecting a lowest edge of side surface of the bond magnet with the upper section of side surface;

a frame coupled to the magnetic circuit;

a voice coil operable to be driven based on a magnetic field generated from the magnetic gap; and a diaphragm, a center of the diaphragm being coupled to the voice coil, and a circumference of the diaphragm being coupled to an outer periphery of the frame, wherein the upper section of side surface faces against the inner surface of the yoke side surface, the upper section of side surface is disposed closer to the yoke side surface than the lowest edge of side surface is, the bond magnet is anisotropic, a magnetic field is oriented from a bottom surface of the bond magnet toward the upper section of side surface, and the first connecting section is provided in an inclined manner with respect to the yoke bottom.

* * * * *